United States Patent [19]

Skjong

[11] Patent Number: 4,909,671

[45] Date of Patent: Mar. 20, 1990

[54] METHOD FOR INSTALLATION OF A BUOYANT BODY ON A SEA BOTTOM

[75] Inventor: Jan Skjong, Sandvika, Norway

[73] Assignee: Norwegian Contractors A/S, Stabekk, Norway

[21] Appl. No.: 194,282

[22] Filed: May 16, 1988

[30] Foreign Application Priority Data

May 14, 1987 [NO] Norway ..... 872009

[51] Int. Cl.[4] ..... E02D 23/02

[52] U.S. Cl. ..... 405/206; 405/204; 405/195

[58] Field of Search ..... 405/204, 205, 203, 209, 405/206; 166/366; 175/10

[56] References Cited

U.S. PATENT DOCUMENTS 3,987,638 10/1976 Burkhardt et al. ..... 405/203
4,253,780 3/1981 Lecomte et al. ..... 405/203 X
4,611,952 9/1986 Saint-M'Leuz ..... 405/204 X

FOREIGN PATENT DOCUMENTS 980575 1/1965 United Kingdom ..... 405/204

*Primary Examiner*—Randolph A. Reese
*Assistant Examiner*—Arlen L. Olsen
*Attorney, Agent, or Firm*—Wenderoth, Lind & Ponack

[57] ABSTRACT

A method of installing a floatable or buoyant body on the sea floor includes towing the body to an installation site at the sea surface and subsequently submerging the body towards the sea floor by supplying ballast to the buoyant body. The supply of ballast is discontinued when the buoyant body reaches a preselected sinking velocity and the vertical movement of the buoyant body is discontinued at a predetermined level above the sea floor by a floating vessel or the like which is floating at the sea surface. One end of the vessel is connected to the buoyant body by a connector system, the length of which is smaller than the sea depth at the installation site. The buoyant body is displaced laterally to a preselected final location, whereafter the buoyant body is further submerged towards the sea floor until the same is positioned on the sea floor at a preselected installation site.

7 Claims, 5 Drawing Sheets

METHOD FOR INSTALLATION OF A BUOYANT BODY ON A SEA BOTTOM

BACKGROUND OF THE INVENTION

The present invention relates to a method of installing a floating or buoyant body on the sea floor. The buoyant body is towed to an installation site in a floating sea surface position and is subsequently completely submerged and lowered towards the sea floor by supplying ballast to the buoyant body.

The subsea installation of structures which do not have a water line area during the submersion operation has hitherto been carried out by means of crane ships. Due to the large dynamic masses involved, the prevailing forces in the supporting cables are inherently difficult to control subject to difficult weather conditions affecting waves, streams, etc.

SUMMARY OF THE INVENTION

With the proposed method according to the present invention, the dynamic forces will be small and easy to control. Particularly when the structures which shall be submersed have a comparatively large size and volume, the method in accordance with the invention may offer substantial advantages compared with conventional methods.

The method will be particularly useful in connection with the submersion of structures having a large volume down to the sea floor. The method renders possible subsea installations with very large dimensions. Since the method is more or less independent of the weather and climatic conditions, the installation can be carried out under relatively severe weather conditions during which a conventional crane ship will not be able to operate.

The method in accordance with the invention is generally based upon the feature that the supply of ballast water to the buoyant body is discontinued when the buoyant body attains a pre-selected sinking velocity, and in that the vertical movement of the buoyant body is discontinued when the buoyant body reaches a predetermined level above the sea floor, whereafter the buoyant body is displaced laterally to a preselected position, and then the buoyant body is submerged further down to the sea floor, while the same is maintained aligned with the preselected location. The vertical movement of the buoyant body is discontinued by means of a vessel floating at the sea surface, one end of which vessel is connected to the buoyant body by means of a connector system. The length of the connector system, such as cables, and the vertical dimension on said vessel should be selected so that the vessel remains floating in a vertical position on the sea surface, even when the buoyant body is finally installed at the sea floor. The cable system should preferably be tensioned when the floating body is installed. The cable system and the surface vessel are removed subsequent to the buoyant body being installed. The surface vessel has an oblong shape and is designed to stand in an upright position during the last part of the installation phase of the buoyant body. The horizontal dimension of the vessel, when the vessel stands in the upright position, is adapted to the maximum dynamic energy which the buoyant body is designed for. The buoyant body is moved in lateral directions by means of towing vessels via towing lines.

When utilizing a surface floating vessel in order to arrest the buoyant body at a certain predetermined level above the sea floor, one must utilize the following energy consideration:

$$\frac{1}{2} mv^2 = \frac{1}{2} kl^2$$

where:

m = the mass of the body, v = the velocity of the body, k = the spring constant of the surface vessel (water line area per meter), l = the distance or height which the surfice vessel is being drawn down.

This physical relationship indicates that a small surface vessel can be utilized to control and arrest movements of a buoyancy neutralized large body at a predetermined level above the sea floor when the said body sinks at a given velocity.

The buoyant body to be submerged must be equipped with the following operating system.

Submersion equipment which will be utilized to control the final phase of submersion. This system can, for instance, consist of a cable attached to the buoyant body. The cable should be able to float through the attachment of buoyant bodies or floats (made of plastics, for example) to the cable at certain intervals. To the end of this cable should be attached a comparatively large surface vessel, for instance, made of steel.

A ballast system which preferably consists of hydraulically operated pumps and valves installed on the buoyant body and operated by means of a preferably hydraulic unit installed at the sea surface and connected to the buoyant body by means of hoses.

The buoyant body is submerged and sunk towards the sea floor by ballasting. The control of the ballast system will be monitored through the hose extending to the sea surface. During the submersion of the buoyant body, the floats attached to the cable will be drawn down. When the buoyant body reaches a certain level above the sea floor, the surface vessel will be activated where by the velocity of the body is reduced to zero. The buoyant body will now be ballasted and submerged futher to a height of about 10 meters above the sea floor and at which vertical position the lateral positioning of the body will be carried out. During the final phase of installation, the surface vessel will offer the required water line area in order to carry out a conventional ballasting operation.

BRIEF DESCRIPTION OF THE DRAWINGS

The present invention shall be described in the following with reference to the attached drawings which illustrate a preferred embodiment, wherein.

DETAILED DESCRIPTION OF THE PREFERRED EMBODIMENT

Figure 1:
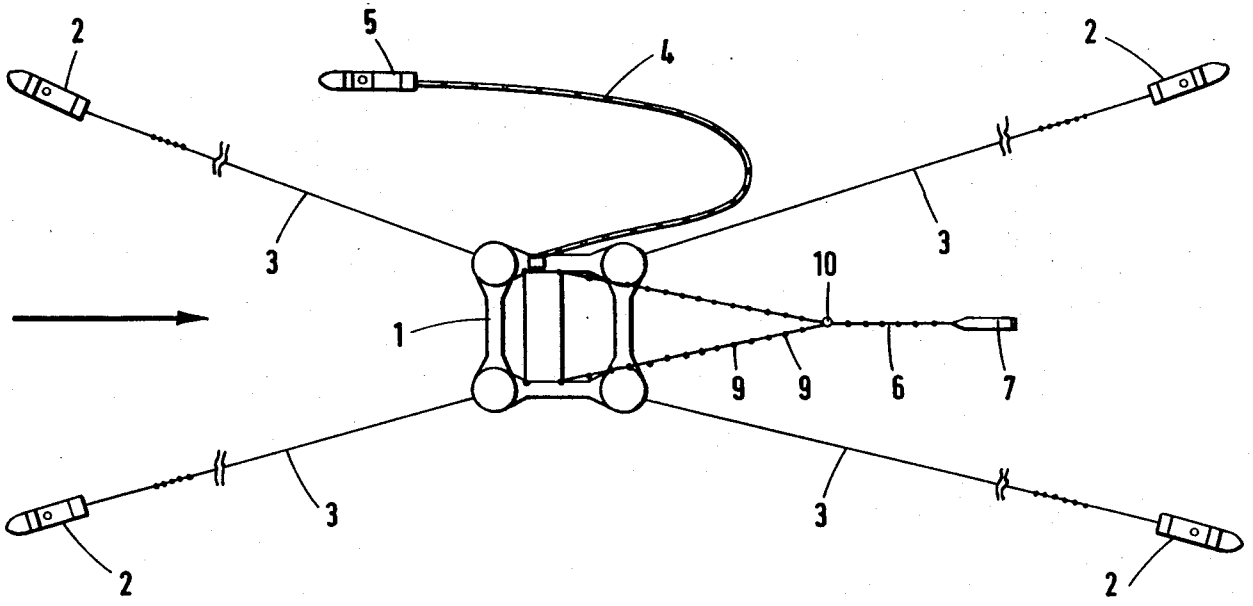
FIG. 1 is a plan view of the buoyant body in a surface position with a surface vessel in a horizontal position, the buoyant body being kept in position by means of towing vessels.

FIG. 1 shows a preferred embodiment of the present invention wherein the buoyant body 1 is in a surface position. The buoyant body 1 is kept in correct position by means of towing vessels 2 with towing cables 3. A so-called "umbilical" 4 is attached at one end to the buoyant body, while the other end is attached to a monitoring unit positioned above a fifth towing vessel 5. A cable system 6 is attached at one end to the buoyant body 1, while the other end is attached to the end of the surface vessel 7. In the position of the buoyant body 1 as shown, the surface vessel 7 is in a horizontal position floating along the sea surface 8. The cables of the cable system 6 are provided with conventional buoyant bodies or floats 9. The shown cable system 6 consists of two cable groups. End portions of the cable groups which are not attached to the buoyant body 1 are attached to each other at a branch by means of a shackle 10 or the like.

The surface vessel 7 is preferably oblong, having for instance a circular, rectangular or square cross section.

The end part of said surface vessel 7 which is connected to the cable system 6 can advantageously have a conical shape. The shown embodiment of the surface vessel 7 has, with the exception of the lower conical end, a constant cross-sectional area. It shall, however, be observed that the vessel can have a cross-sectional area that varies in the longitudinal direction of the vessel 7, and preferably has a cross-sectional area that increases in a direction extending away from the attachment point for the cable system 6.

Figure 2:
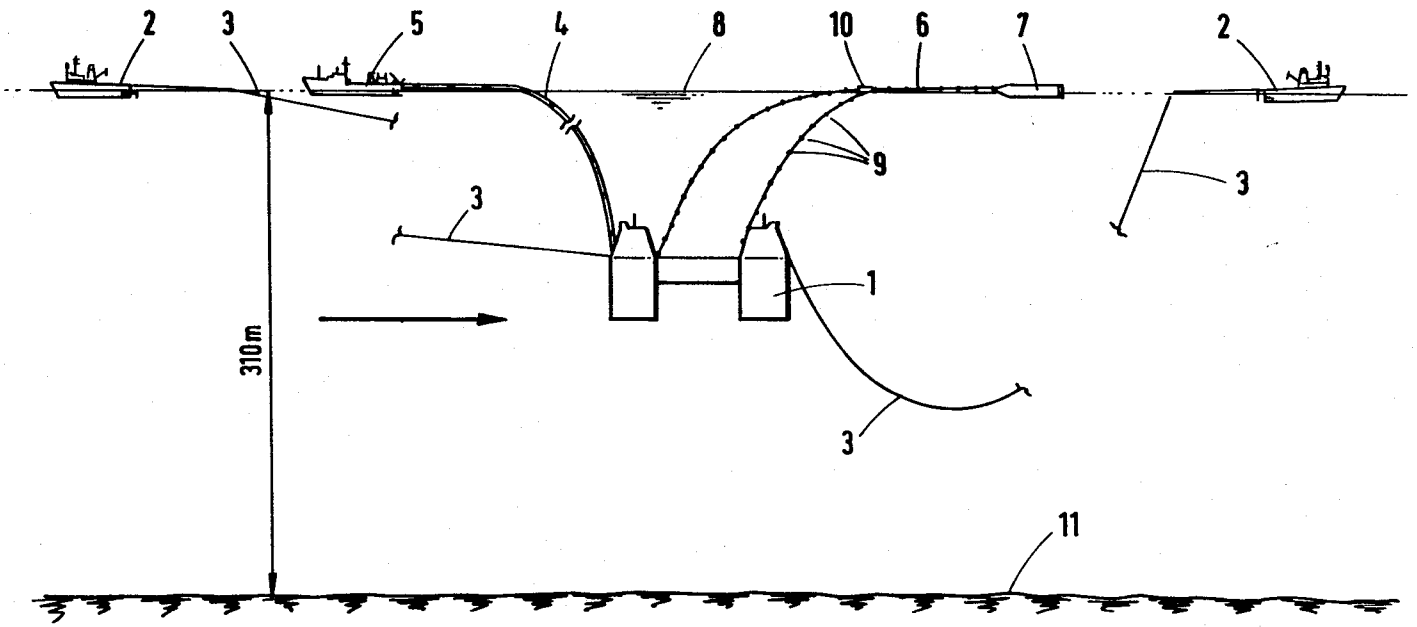
FIG. 2 is a side view through the sea floor showing the buoyant body in a partly submerged position on its way down towards the sea floor and wherein the surface vessel is still in a horizontal position.

FIG. 2 shows the buoyant body 1 in a position wherein the buoyant body 1 is completely submerged and the buoyant body 1 is sinking in a controlled fashion towards the sea floor 11. In this phase, the towing lines 3 are at the outset not substantially tensioned. Further, the vertical movement of the buoyant body is relatively small. The umbilical 4—which should not be subjected to substantial tension loads—is kept slack during this phase, for instance, due to the towing vessel 5 monitoring the umbilical 4 to ensure that it is not tensioned, and due to the paying out of the umbilical 4 from a drum on the deck of the towing vessel (not shown). In this phase the vessel 7 is floating with the longitudinal axis still in more or less a horizontal position.

Figure 3:
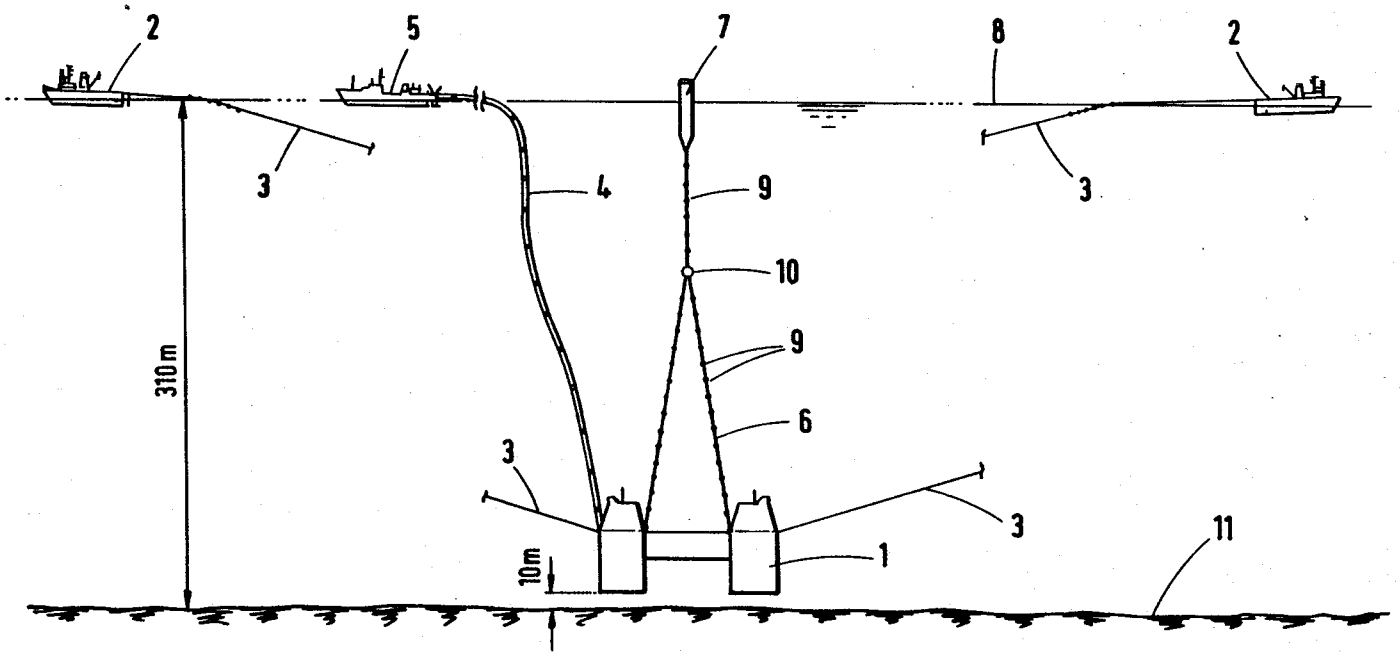
FIG. 3 is a similar side view showing the buoyant body in a position wherein the submersion velocity is zero and wherein the surface vessel has attained a vertical position.

FIG. 3 shows the buoyant body 1 when the downward movement thereof has been discontinued and wherein the buoyant body 1 is kept in a pre-selected position, for instance about 10 meters above the sea floor 11. The cable system 6 is in this position subjected to full tension, and the surface vessel 7 has its longitudinal axis extending more or less vertically. The dimension of the part of the vessel 7 which is extending above the sea surface 8 exceeds the distance between the sea floor 11 and the underside of the buoyant body 1 inclusive the height of that part of the body 1 which in some applications is designed for penetrating the sea floor 11, either under the force of gravity or under a vacuum. From this position the buoyant body 1 is moved laterally to correct its position relative to a preselected installation site on the sea bottom 11 by means of the towing vessels 2.

Figure 4:
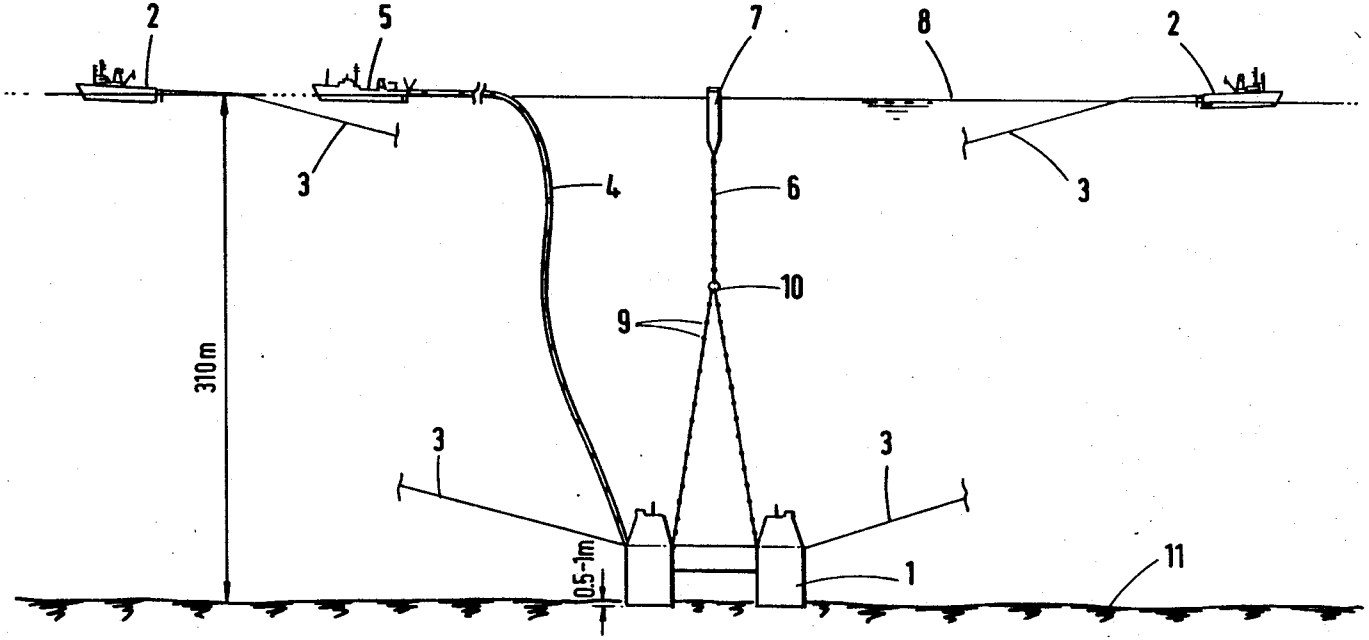
FIG. 4 is a similar side view wherein the buoyant body has reached an installed position on the sea floor and wherein the surface vessel has not yet been removed.

From this position to the site at which the body is installed on the sea floor, (FIG. 4) the buoyant body 1 and/or the surface vessel 7 are ballasted. As shown in FIG. 4, the buoyant body 1 will thereby be pressed down 0.5 to 1 meter into the sea floor. Upon reaching such a position, the surface vessel 7 is released. The last part of the penetration of the sea floor by the buoyant body can be accomplished by supplying ballast into the buoyant body.

Figure 5:
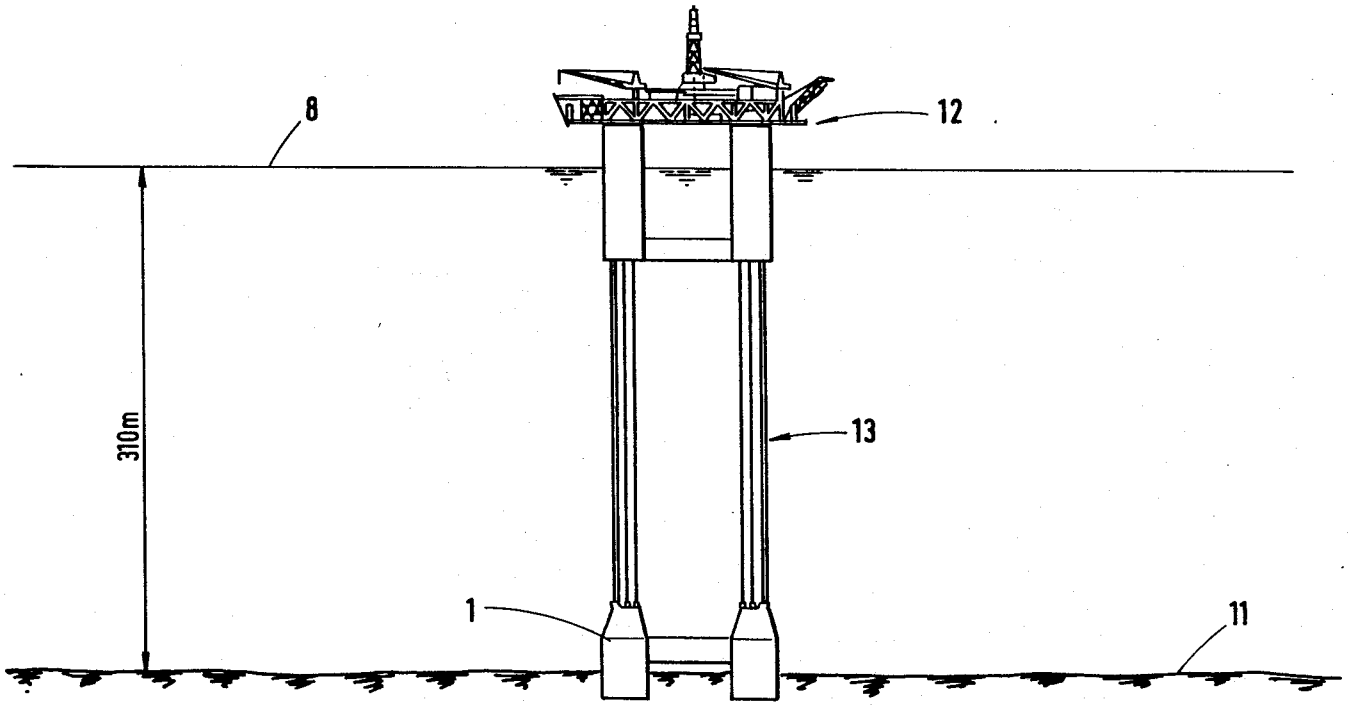
FIG. 5 is a side view illustrating a possible utilization of the buoyant body.

FIG. 5 illustrates the use of the buoyant bodies 1 as described in connection with FIGS. 1 to 4. As shown, the buoyant body serves as a bottom anchor for a tension leg platform 12. Tension legs 13 extend between the platform 12 and the anchor.

I claim:

1. A method of installing a ballastable buoyant body, at a preselected installation site on the sea floor, said method comprising:

towing the buoyant body to a surface position located on the surface of the sea;

providing a floating vessel having a buoyancy that is sufficient to arrest the sinking of the buoyant body in the sea when the buoyant body is sinking at a predetermied velocity;

connecting the floating vessel to said buoyant body with a flexible connector system having an effective length with tensioed, said effective length and the height of the buoyant body being less than the depth of the sea at the installation site;

supplying ballast to the buoyant body when at the surface position to cause the buoyant body to sink;

disconnecting the supply the ballast to the buoyant body after the buoyant body has been connected to the floating vessel and when the buoyant body begins sinking at said predetermined velocity so that the floating vessel arrests the sinking of the buoyant body at a preselected level above the sea floor;

displacing the buoyant body laterally, at the preselected level, to the extent necessary to position the buoyant body at said preselected level directly above the installation site; and maintaining the connection of the vessel to the buoyant body and, with the vessel so connected to the buoyant body, supplying ballast to at least one of said buoyant body and said floating vessel when the buoyant body is positioned directly above the installation site to overcome the buoyancy of the vessel and sink the buoyant body to the installation site with said connector system connecting said vessel to said buoyant body.

2. A method as claimed in claim 1, wherein tension in the connector system is maintained when the buoyant body is sunk to the installation site.

3. A method as claimed in claim 2, wherein the step of providing the floating vessel comprises providing a floating vessel having an oblong shape with will float upright in the sea as the buoyant body is sunk from the preselected level to the installation site.

4. A method as claimed in claim 3, wherein the step of providing the floating vessel comprises providing a floating vessel having a tapered end, and said step of connecting comprises connecting the connector system to the tapered end of the floating vessel.

5. A method as claimed in claim 4, wherein the step of providing the floating vessel comprises providing a floating vessel having a crosssectional area that increases in a direction away from the end at which the connector system is attached.

6. A method as claimed in claim 2, and further comprising the step of disconnecting the connector system and the floating vessel from the buoyant body after the buoyant body is sunk to the installation site.

7. A method as claimed in claim 1, wherein the providing of the floating vessel comprises providing a floating vessel having predetermined dimensions that allow only a part of the floating vessel to remain above the surface of the sea when the buoyant body is sunk from the preselected level to the installation site with the connector system connecting the floating vessel to the buoyant body.

* * * * *

UNITED STATES PATENT AND TRADEMARK OFFICE

CERTIFICATE OF CORRECTION

PATENT NO. : 4,909,671

DATED : March 20, 1990

INVENTOR(S) : Jan Skjong

It is certified that error appears in the above-identified patent and that said Letters Patent is hereby corrected as shown below:

The title page showing the illustrative figure should be deleted to appear as per attached title page.

Signed and Sealed this

Twenty-sixth Day of February, 1991

*Attest:*

HARRY F. MANBECK, JR.

*Attesting Officer*

*Commissioner of Patents and Trademarks*

United States Patent [19]

Skjong

[11] Patent Number: 4,909,671

[45] Date of Patent: Mar. 20, 1990

[54] METHOD FOR INSTALLATION OF A BUOYANT BODY ON A SEA BOTTOM

[75] Inventor: Jan Skjong, Sandvika, Norway

[73] Assignee: Norwegian Contractors A/S, Stabekk, Norway

[21] Appl. No.: 194,282

[22] Filed: May 16, 1988

[30] Foreign Application Priority Data

May 14, 1987 [NO] Norway ..... 872009

[51] Int. Cl.[4] ..... E02D 23/02

[52] U.S. Cl. ..... 405/206; 405/204; 405/195

[58] Field of Search ..... 405/204, 205, 203, 209, 405/206; 166/366; 175/10

[56] References Cited

U.S. PATENT DOCUMENTS 3,987,638 10/1976 Burkhardt et al. ..... 405/203
4,253,780 3/1981 Lecomte et al. ..... 405/203 X
4,611,952 9/1986 Saint-M'Leuz ..... 405/204 X

FOREIGN PATENT DOCUMENTS 980575 1/1965 United Kingdom ..... 405/204

*Primary Examiner*—Randolph A. Reese
*Assistant Examiner*—Arlen L. Olsen
*Attorney, Agent, or Firm*—Wenderoth, Lind & Ponack

[57] ABSTRACT

A method of installing a floatable or buoyant body on the sea floor includes towing the body to an installation site at the sea surface and subsequently submerging the body towards the sea floor by supplying ballast to the buoyant body. The supply of ballast is discontinued when the buoyant body reaches a preselected sinking velocity and the vertical movement of the buoyant body is discontinued at a predetermined level above the sea floor by a floating vessel or the like which is floating at the sea surface. One end of the vessel is connected to the buoyant body by a connector system, the length of which is smaller than the sea depth at the installation site. The buoyant body is displaced laterally to a preselected final location, whereafter the buoyant body is further submerged towards the sea floor until the same is positioned on the sea floor at a preselected installation site.

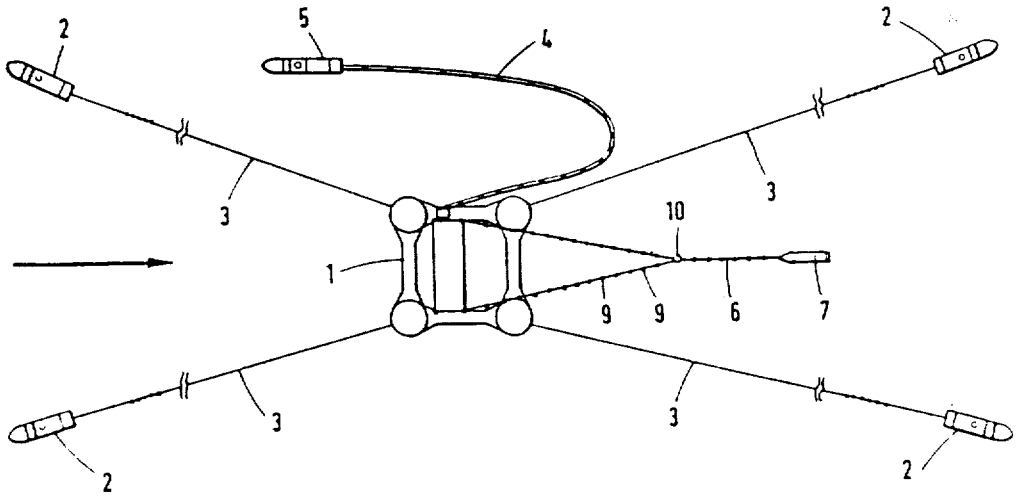

7 Claims, 5 Drawing Sheets